US009476221B2

(12) United States Patent
Marshall

(10) Patent No.: US 9,476,221 B2
(45) Date of Patent: Oct. 25, 2016

(54) MODULAR CONCRETE FENCE SYSTEM

(71) Applicant: Dale R. Marshall, Calgary (CA)

(72) Inventor: Dale R. Marshall, Calgary (CA)

( * ) Notice: Subject to any disclaimer, the term of this patent is extended or adjusted under 35 U.S.C. 154(b) by 0 days.

(21) Appl. No.: 14/636,673

(22) Filed: Mar. 3, 2015

(65) Prior Publication Data

US 2016/0258185 A1 Sep. 8, 2016

(51) Int. Cl.

| | |
|---|---|
| ***E04H 17/16*** | (2006.01) |
| ***E04H 17/20*** | (2006.01) |
| ***E04C 2/04*** | (2006.01) |
| *E04H 17/14* | (2006.01) |

(52) U.S. Cl.

CPC ..... *E04H 17/168* (2013.01); *E04C 2/044* (2013.01); *E04H 17/20* (2013.01); *E04H 2017/1447* (2013.01)

(58) Field of Classification Search

CPC ..... E04H 17/16; E04H 17/168; E04H 17/20; E04H 17/22; E04H 12/22; E04H 12/2253; E04H 12/2269; E04H 12/2292; E04H 2017/1447; E04F 11/1851; E04F 11/1812; E04B 2001/2684; E04C 2/044

See application file for complete search history.

(56) References Cited

U.S. PATENT DOCUMENTS

| | | | | | |
|---|---|---|---|---|---|
| 2,644,553 | A * | 7/1953 | Cushman | E04B 1/6179 | 114/201 R |
| 3,170,201 | A * | 2/1965 | Nofziger | E04H 17/18 | 256/19 |
| 4,722,633 | A * | 2/1988 | Bergheim | E04B 1/6179 | 403/248 |
| 4,930,753 | A * | 6/1990 | Alvyn | E04B 1/6158 | 16/262 |
| 5,272,850 | A * | 12/1993 | Mysliwiec | E04B 1/6158 | 52/582.2 |
| 5,373,678 | A | 12/1994 | Hesser | | |
| 5,400,563 | A * | 3/1995 | House | E01F 8/0011 | 256/13.1 |
| 5,404,685 | A * | 4/1995 | Collins | E04H 17/168 | 256/19 |
| 5,471,811 | A * | 12/1995 | House | E01F 8/0011 | 256/13.1 |
| 5,887,404 | A | 3/1999 | Kreizinger | | |
| 5,913,781 | A * | 6/1999 | Vidmar | A01G 1/08 | 16/223 |
| 5,957,424 | A * | 9/1999 | Krinner | E04H 12/2253 | 248/514 |
| 6,152,428 | A * | 11/2000 | Simioni | E04H 17/166 | 256/19 |
| 6,213,452 | B1 * | 4/2001 | Pettit | E04F 11/1812 | 248/188.8 |
| 6,827,336 | B2 | 12/2004 | Hwang | | |
| 7,216,853 | B2 * | 5/2007 | Wall | E04H 17/16 | 256/24 |
| 7,802,409 | B2 | 9/2010 | Stott | | |
| 2008/0237560 | A1 * | 10/2008 | Dehlsen | E01F 9/0124 | 256/65.14 |
| 2009/0134378 | A1 * | 5/2009 | Petta | E04F 11/1834 | 256/67 |
| 2010/0314596 | A1 | 12/2010 | Thomas | | |

FOREIGN PATENT DOCUMENTS

| | | | | |
|---|---|---|---|---|
| CA | 2322610 | A1 * | 4/2002 | E04H 17/1421 |
| CA | 2462360 | A1 * | 10/2005 | E04F 11/1812 |
| FR | 2741903 | A1 * | 6/1997 | E04F 11/181 |

* cited by examiner

*Primary Examiner* — Jonathan Masinick
(74) *Attorney, Agent, or Firm* — Lerner, David, Littenberg, Krumholz & Mentlik, LLP

(57) ABSTRACT

The present fencing system includes panel modules having a substantially planar central panel with semicolumnar projections extending at either side. The semicolumnar projections each have a longitudinal slot extending between the top edge and the bottom edge, such that two adjacent panel modules overlap to form a column element having an internal cavity. A support column secured to the ground is received within the internal cavity formed by the longitudinal slots of overlapping semicolumnar projections. One or more connection brackets fixed to the panel module engage the support column to hold the panel modules in place.

8 Claims, 6 Drawing Sheets

MODULAR CONCRETE FENCE SYSTEM

BACKGROUND OF THE INVENTION

The present invention relates to fences, and specifically to a modular fencing system including pre-cast concrete panels.

Concrete fences and walls find many applications for outdoor use in landscaping, or as sound barriers to protect residents near noisy highways and airports. Modular fence and wall systems including pre-formed panels are known. Such systems are often assembled from modular panels which are connected by fitting a protrusion on an end of one panel or column into a recess in an end of an adjacent panel or column. For example, U.S. Pat. No. 7,802,409, U.S. Pat. No. 6,827,336, U.S. Pat. No. 5,887,404, U.S. Pat. No. 5,373,678 and US Patent Application Publication 2010/0314596 describe such systems. However, such fencing systems need to be assembled progressively from one end so that the end of a newly added panel can connect properly to previously placed panels. This requirement limits flexibility during the assembly process, as it may not be easy or even possible to independently assemble sections of the fence which are separate from each other, and to connect the individual sections later by adding panels between the sections. Furthermore, it can be difficult and costly to replace a damaged panel in the middle of a fencing run. Sufficient clearance is required within the end connections between the panels and the columns in order for the panel to be removed and replaced, and in many cases, the damaged panel must be lifted its entire vertical height to clear the adjacent fence sections while the replacement panel to be added must also be inserted from a similar height. Therefore, there is a need in the art for alternative concrete fencing systems which can address one or more of the above-mentioned issues.

SUMMARY OF THE INVENTION

One aspect of the present invention provides a fencing system comprising:

a plurality of panel modules, each panel module having a first face, a second face, a top edge and a bottom edge, wherein each panel module comprises:

a central panel having a first side end and a second side end, the central panel defining a central plane;

a first semicolumnar projection extending from the first side end of the central panel parallel to the central plane and offset therefrom towards the first face, the first semicolumnar projection comprising a first slot extending between the top edge and the bottom edge and opening towards the second face; and a second semicolumnar projection extending from the second side end of the central panel parallel to the central plane and offset therefrom towards the second face, the second semicolumnar projection comprising a second slot extending between the top edge and the bottom edge, the second slot opening towards the first face;

wherein overlapping coupling of the first semicolumnar projection of a first panel module with the second semicolumnar projection of an adjacent second panel module to align the first slot of the first panel module with the second slot of the second panel module provides an internal cavity;

a substantially rigid ground-engaging support column longitudinally receivable in the internal cavity, the support column comprising a first ground-engaging end and a second open end; and one or more connection brackets fixable to the panel module so as to extend into the internal cavity, the one or more connection brackets each comprising an engagement element configured to engage the support column at the open end.

In at least one embodiment of the present fencing system, the panel module comprises at least one connection bracket receiving recess extending from at least one of the first side end and the second side end of the central panel along the top edge of the panel module and wherein the one or more connection brackets are fixedly receivable in the at least one connection bracket receiving recess so as to extend into the internal cavity.

In at least one embodiment of the present fencing system, the engagement element is laterally extendable from the connection bracket so as to engage one or more interior walls of the open end of the support column.

In at least one embodiment of the present fencing system, the engagement element comprises one or more threaded elements laterally threadedly extendable from the connection bracket so as to engage the one or more interior walls of the open end of the support column. Lateral extension and retraction of the one or more threaded elements relative to the connection bracket is operable to adjust the vertical alignment of the panel module.

In at least one embodiment of the present fencing system, the engagement element further comprises one or more jam nuts threadedly received on the one or more threaded elements and operable to restrict lateral extension and retraction of the one or more threaded elements relative to the connection bracket.

In at least one embodiment, the present fencing system further comprises a lower bracket, wherein the first and second semicolumnar projections each comprise a lower recess in the bottom edge thereof, and wherein the lower bracket comprises an aperture to receive the support column and one or more projections each receivable in the lower recess of the first or second semicolumnar projection, so as to retain and align the first and/or second semicolumnar projections adjacent to the support column.

BRIEF DESCRIPTION OF THE DRAWINGS

Further features of the present invention will become apparent from the following written description and the accompanying figures, in which.

DETAILED DESCRIPTION

Specific illustrative and non-limiting embodiments of the present fencing system will now be described with reference to the Figures.

As used herein, the term "substantially" refers to the complete or nearly complete extent or degree of an action, characteristic, property, state, structure, item, or result. For example, an object that is "substantially" aligned would mean that the object is either completely aligned or nearly completely aligned. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, terms indicating relative direction or orientation, including but not limited to "upper", "lower", "vertical", "horizontal", and the like, are intended to facilitate description of the present fencing system by indicating relative orientation or direction in usual use, and are not intended to limit the scope of the present invention in any way to such orientations or directions.

Figure 1:
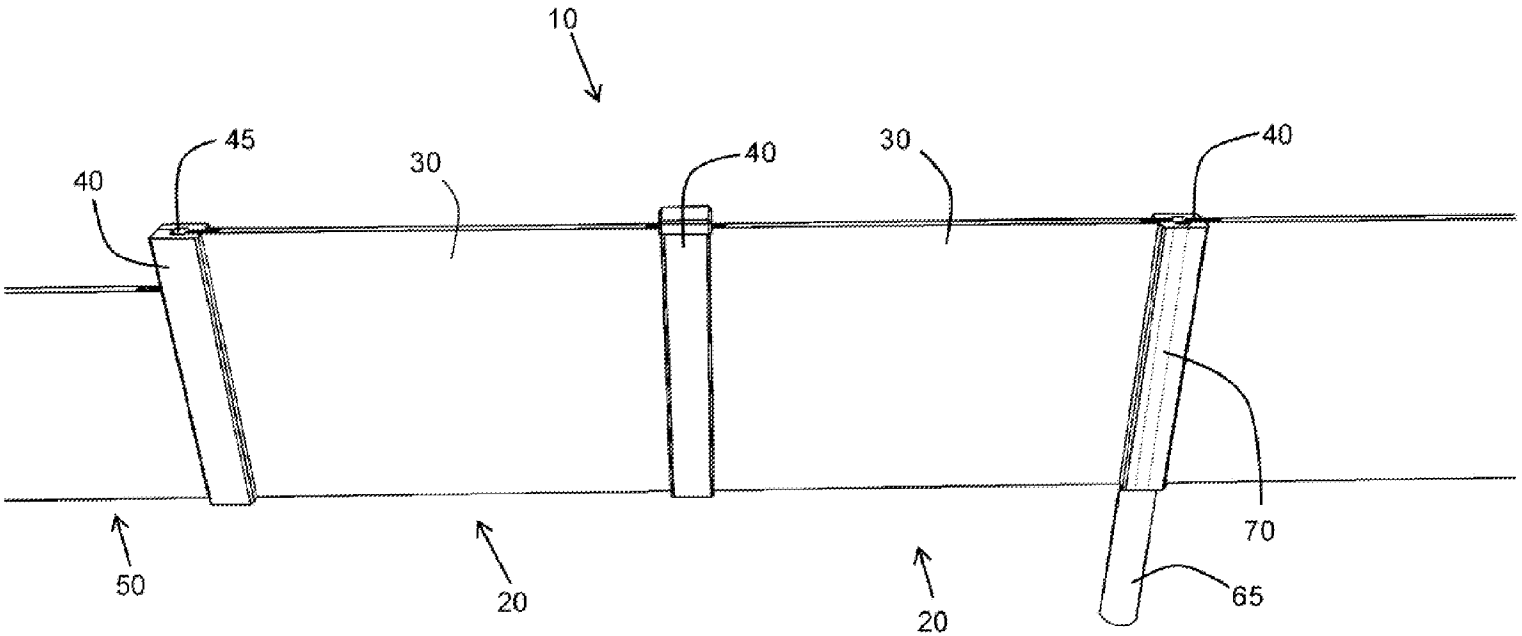
FIG. 1 is a top perspective partial view of an embodiment of a fencing system according to the present invention.
Figure 2:
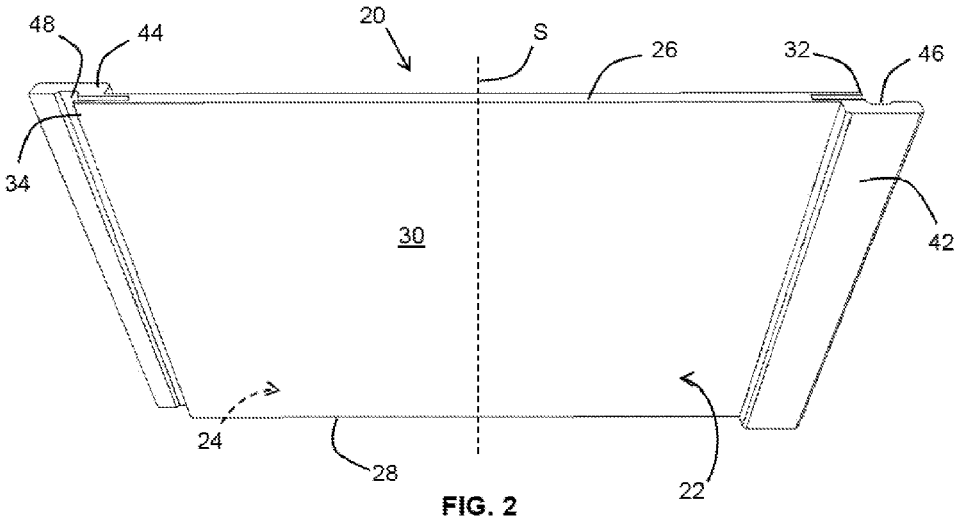
FIG. 2 is a top perspective view of a panel module for the embodiment of FIG. 1.

In at least one embodiment, seen in FIGS. 1 and 2, the present fencing system includes a plurality of pre-cast concrete panel modules 20. Each panel module 20 has a first face 22, a second face 24 opposite the first face, a top edge 26 and a bottom edge 28. Viewed as the panel module would be oriented vertically in use in a fence, the bottom edge 28 is proximal to the ground or substrate and the top edge 26 is opposite the bottom edge 28 and distal from the ground or substrate. The first face 22 can be either the front face, as seen in FIG. 2, or the back face, and the second face 24 is the opposite face to the first face 22. Thus, if the first face 22 is the front face, the second face 24 will be the back face, and if the first face 22 is the back face, the second face 24 will be the front face.

Each panel module 20 comprises a central panel 30 which defines a central plane. As the panel module 20 would be oriented in use, the central plane is a vertical plane oriented approximately perpendicular to the horizontal, as understood in the art. As seen in FIG. 1, each central panel 30 in the assembled fencing system 10 is separated from an adjacent central panel by a column element 40.

As best seen in FIG. 2, each central panel 30 has a first side end 32 and a second side end 34 opposite the first side end. Extending from each first and second side end 32, 34 in a plane parallel to the central plane is a semicolumnar projection 42, 44. The first semicolumnar projection 42 extends from the first side end 32 of the central panel 30 and is offset from the central plane towards the first face 22. The second semicolumnar projection 44 extends from the second side end 34 of the central panel and is offset from the central plane towards the second face 24. Thus, the semicolumnar projections 42, 44 at each end of the central panel 30 of the panel module 20 are offset from the central plane in opposite directions from each other.

The first semicolumnar projection 42 includes a first longitudinal slot 46 extending vertically between the top edge 26 and the bottom edge 28 of the panel module 20, as oriented in use. The first slot 46 opens towards the second face 24. Likewise, the second semicolumnar projection 44 includes a second longitudinal slot 48 extending between the top edge 26 and the bottom edge 28, such that the second slot 48 opens towards the first face 22. Thus, the first and second slots 46, 48 each open towards opposite faces 22, 24, so that the first and second semicolumnar projections 42, 44 are mirror images of each other and located at opposite ends 32, 34 of the central panel.

The skilled person will understand in view of the teachings herein that, aside from possible differences in markings or decorations on the first and second faces 22, 24, the panel module 20 of the present invention, as oriented in use, has a vertical two-fold rotational axis of symmetry S located centrally in the central plane. Thus, when panel module 20 is rotated by 180° from an initial orientation around the rotational axis of symmetry S, such that first semicolumnar projection 42 assumes the position previously occupied by second semicolumnar projection 44 and vice versa, panel module 20 assumes an orientation having the same appearance and function as the initial orientation. Thus, first semicolumnar projection 42 and second semicolumnar projection 44 are interchangeable in the use of panel module 20.

During assembly of the present fencing system, the first semicolumnar projection 42 of a first panel module 20 is positioned opposite a complementary second semicolumnar projection 44 of an adjacent second panel module 20 so as to align the first slot 46 of the first panel module 20 with the second slot 48 of the adjacent second panel module 20, as seen in FIG. 1. Thus, the first semicolumnar projection 42 overlaps the complementary second semicolumnar projection 44 to form column element 40 having an internal cavity 45 formed from first slot 46 and second slot 48. In this way, the central planes of adjacent panel modules 20 are substantially aligned with each other to form a substantially straight fence.

Figure 3:
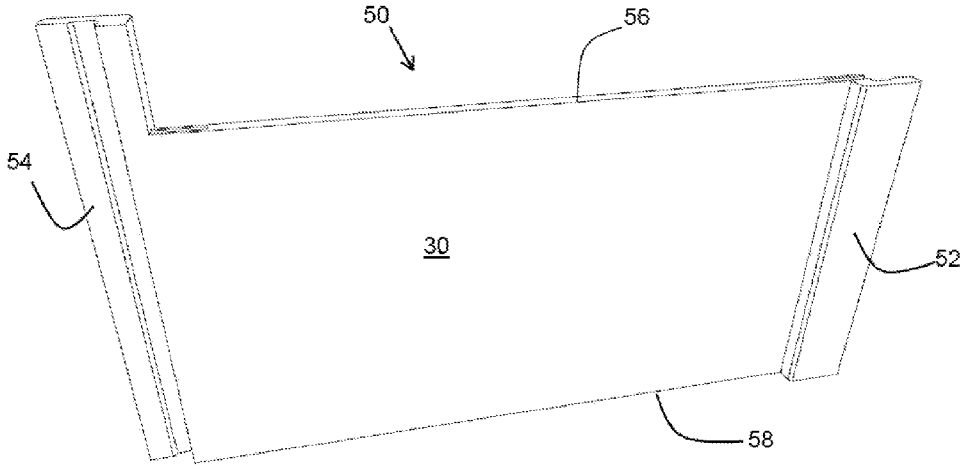
FIG. 3 is a top perspective view of an alternative "step-down" panel module for the embodiment of FIG. 1.
Figure 4:
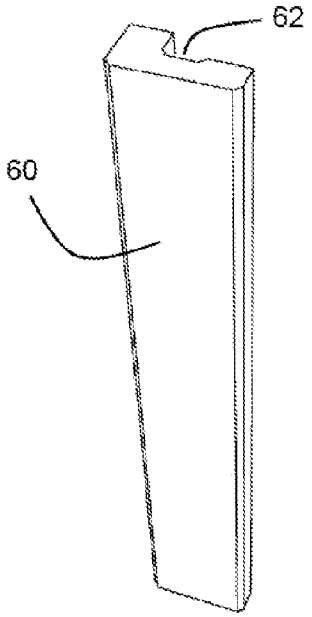
FIG. 4 is a top perspective view of an end cap for the embodiment of FIG. 1.

As seen in FIGS. 1 and 3, an alternative embodiment of the panel module 50 can be used when it is desired that the column elements 40 at each end of the panel module be at different heights, for example, as the fence follows rising or falling contours of the landscape, as will be understood in the art. Panel module 50 includes first semicolumnar projection 52 and second semicolumnar projection 54. First and second semicolumnar projections 52, 54 are substantially similar in structure and function to first and second semicolumnar projections 42, 44 described above, except that they extend to different heights with respect to the top edge 56 of central panel 30 of panel module 50.

As will be appreciated by the skilled person, because of this height difference, panel module 50 does not have a rotational axis of symmetry as described above for panel module 20, and panel module 50 will usually be oriented in use such that the first or second semicolumnar projection 52, 54 overlaps with a complementary semicolumnar projection of similar height on an adjacent panel module. It will also be apparent to the skilled person that either first semicolumnar projection 52 can be shorter than second semicolumnar projection 54, as seen in FIG. 3, or first semicolumnar projection 52 can be taller than second semicolumnar projection 54, as required for the particular application. Furthermore, first semicolumnar projection 52 or second semicolumnar projection 54 can each either extend above the top edge 56 of central panel 30, or below the bottom edge 58 of central panel 30, or both, as required for the particular application.

The person of skill in the art will understand that when a fencing system according to the present invention reaches the end of a run, there will be no corresponding semicolumnar projection of an adjacent panel module to overlap with the final semicolumnar projection of the last panel module. Thus, the present fencing system can include an end cap 60 including a longitudinal slot 62 substantially similar to first and second slots 46, 48 described above. End cap 60 can overlap with the final semicolumnar projection in the fence run to form a column element 40 including an internal cavity 45 in the same way as could a complementary semicolumnar projection of an adjacent panel module, thereby to provide a finished end to the fence run.

Figure 6:
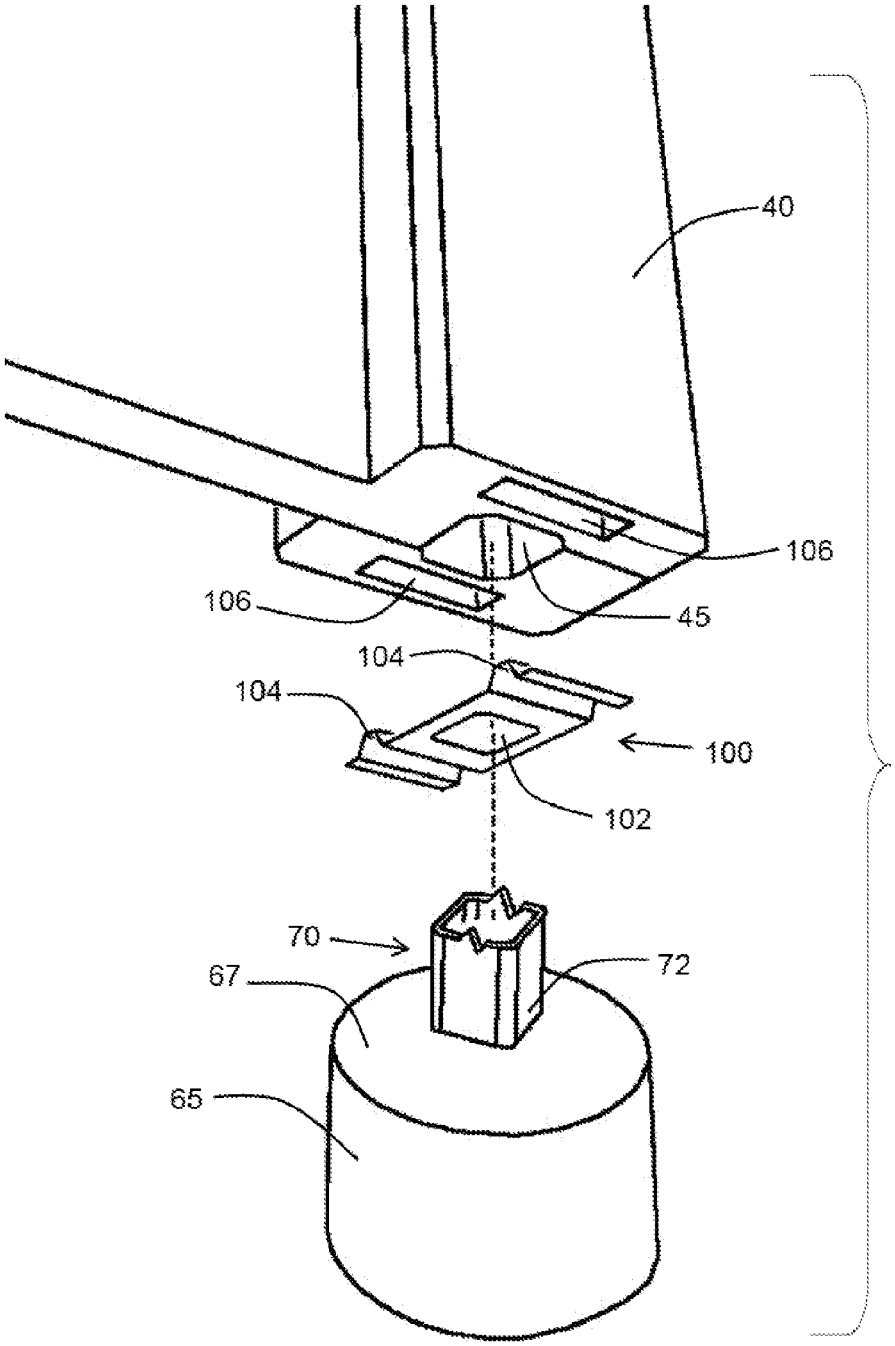
FIG. 6 is an exploded bottom perspective view showing panel modules for the embodiment of FIG. 1 being supported on a support post set in a concrete footing.

The present fencing system also includes a substantially rigid ground-engaging support column 70. The support column 70 is advantageously made of hollow structural steel, and can securely engage the ground so as to extend vertically therefrom by any method known in the art, including but not limited to embedment in a concrete footing or pile 65, as seen in FIGS. 1 and 6. Support column 70 has a lower end 72 which is embeddable in the concrete footing or pile 65, and an upper open end 74. As will be understood by the skilled person, the concrete footing or pile 65 not only supports the support column 70 but provides an upper surface 67 upon which column elements 40 rest after assembly of fence 10.

Figure 7:
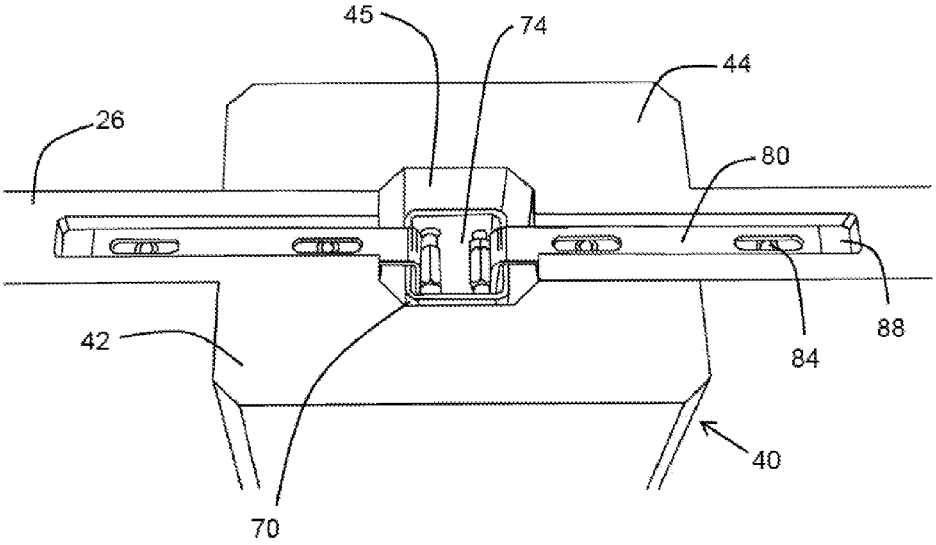
FIG. 7 is a top perspective view showing panel modules for the embodiment of FIG. 1 connected by connection brackets.

As best seen in FIGS. 1, 6 and 7, in use, support column 70 is received in internal cavity 45. While support column 70 is shown cut away in the exploded view of FIG. 6, so as not to obscure other details, support column 70 extends longitudinally substantially the length of internal cavity 45 within column element 40, as seen in FIG. 1. Thus, open end 74 of support column 70 is proximal to the top edge 26 of panel modules 20 whose first and second semicolumnar projections 42, 44 overlap to form column element 40 with internal cavity 45, as seen in FIG. 7. Likewise, in one or more embodiments, open end 74 of support column 70 will be proximal to the top edge of a column element 40 formed by overlap of any of first semicolumnar projections 42, 52, second semicolumnar projections 44, 54 and/or end caps 60.

Figure 8:
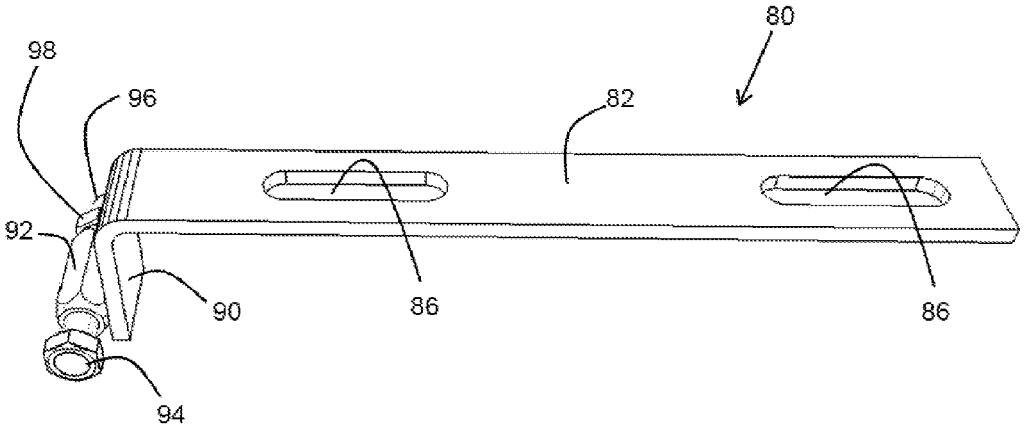
FIG. 8 is a top perspective view of the connection bracket of FIG. 7.

With reference to FIGS. 7 and 8, first semicolumnar projection 42, 52 and second semicolumnar projection 44, 54 are fixed to each other or to an end cap 60 and to support column 70 by means of L-shaped connection brackets 80. Leg 82 of connection bracket 80 can be fixed to top edge 26 of a panel module 20, or to a corresponding top edge 56 of a panel module 50, for example, by means of fasteners, such as bolts 84, for example, passing through slots 86. In at least one embodiment, leg 82 can be recessed into a recess 88 in top edge 26. However, leg 82 need not be recessed into top edge 26.

Leg 90 of connection bracket 80 extends into internal cavity 45, and into the open end 74 of support column 70. Leg 90 is attached to coupling nut 92, into which tap bolts 94, 96 are threaded. Extension of tap bolts 94, 96 from coupling nut 92 towards the inner walls of open end 74 engages tap bolts 94, 96 with the inside walls of support column 70, to fix panel modules 20, 50 to support column 70.

In addition, as will be clear to the person of skill in the art, adjustment of the relative degrees of extension of each of tap bolts 94, 96 from coupling nut 92 can adjust the lateral position of panel module 20, 50 relative to support column 70, by adjusting the lateral position of connection bracket 80 within open end 74 of support column 70. As connection bracket 80 is moved closer to or further away from each lateral internal wall of open end 74 by extension or retraction of tap bolts 94, 96, panel module 20, 50, which is fixed to connection bracket 80, is moved frontwards or backwards with respect to support column 70. Thus, adjustment of tap bolts 94, 96 can be used to ensure that each panel module 20 is vertical and plumb. When tap bolts 94, 96 have been adjusted as necessary to engage support column 70 and to adjust the vertical alignment of panel module 20 such that panel module 20 is plumb, they can be fixed in place by tightening one or more jam nuts or locknuts 98.

Figure 9A:
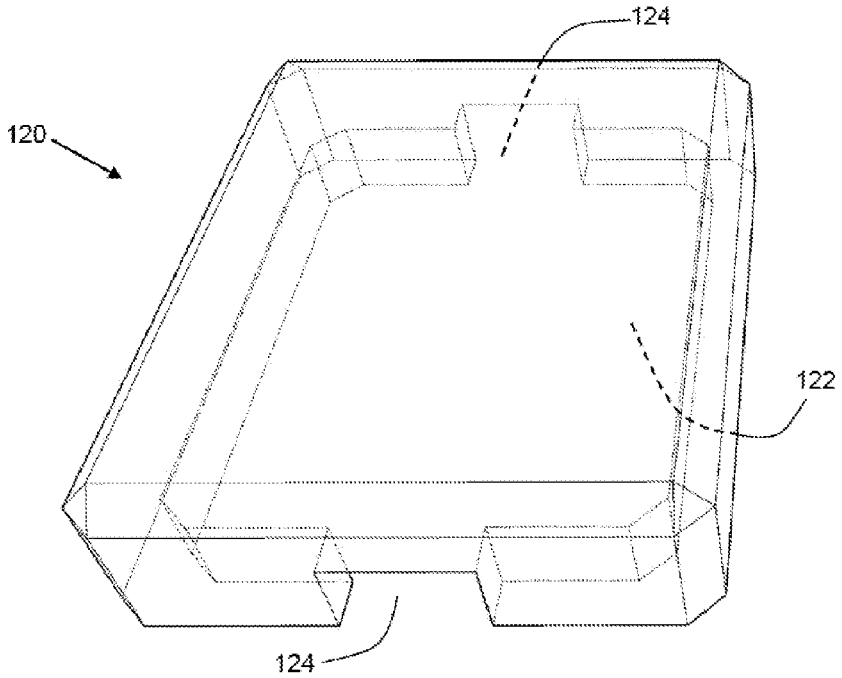
FIG. 9A is a top perspective view of a mid-run top cap, showing the interior structure in dotted lines.
Figure 9B:
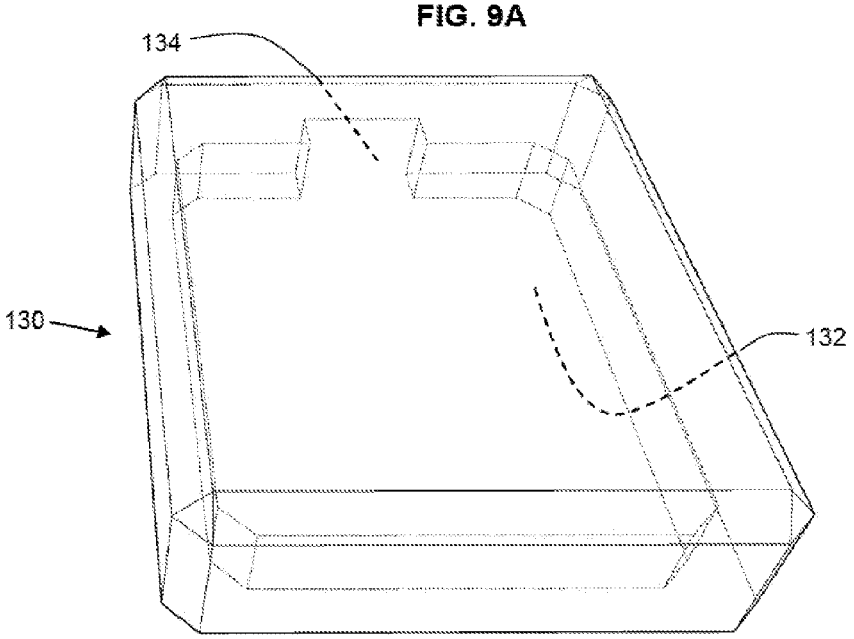
FIG. 9B is a top perspective view of an end-of-run top cap, showing the interior structure in dotted lines.

Column elements 40 can be capped with a mid-run top cap 120 in the middle of a fence run, or with an end-of-run top cap 130 at the end of a fence run, so as to protect connection bracket 80 and the upper open end 74 of support column 70 from exposure to weather, and to provide an esthetically pleasing finished appearance. In at least one embodiment, as seen in FIGS. 9A and 9B, top caps 120, 130 are made of pre-cast concrete, and have an internal recess 122, 132 shaped and sized to accommodate the top of column element 40. Side recesses 124, 134 accommodate the top edge of an adjacent central panel 30, and help to retain top caps 120, 130 in place atop column elements 40. As will be understood by the skilled person, mid-run top cap 120 is useful to cap a column element 40 formed in the middle of a fence run by overlap of a first semicolumnar projection 42, 52 with a second semicolumnar projection 44, 54. Similarly, end-of-run top cap 130 is useful to cap a column element 40 formed at the end of a fence run by overlap of a first or second semicolumnar projection 42, 44, 52, 54 with an end cap 60.

In addition, as seen in FIG. 6, complementary semicolumnar projections 42, 44, 52, 54 and/or end caps 60 can be connected at their bottom edges to form column element 40 by means of lower bracket 100, located between concrete footing 65 and column element 40. Central aperture 102 in lower bracket 100 receives support column 70 as support column 70 passes through internal cavity 45 in column element 40. Tapered projections 104 on lower bracket 100 are received in recesses 106 in column element 40, and held in place by the weight of column element 40 supported on concrete footing 65, thereby preventing separation of complementary semicolumnar projections 42, 44, 52, 54 and/or end caps 60, and retaining and aligning semicolumnar projections 42, 44, 52, 54 and/or end caps 60 adjacent to support column 70 at its lower end 72.

As will be appreciated by one skilled in the art, the overlapping positioning of first semicolumnar projection 42, 52 with second semicolumnar projection 44, 54 to form column element 40 enclosing support column 70 has advantageous properties. Assembly of the present fence 10 need not start at one end and progress one panel at a time. Rather, as long as there is an appropriate amount of space between fence sections to accommodate any panel modules to be inserted later, as will be understood in the art, any section of the fence can be assembled in any order. Furthermore, if a panel module in the middle of a run should be damaged or need replacement, the panel module need not be lifted its entire vertical height to be extracted from the middle of the run. Rather, the damaged panel module need only be released from connection to the support column by disengaging its connection bracket from the upper open end of the support column, disengaging the damaged panel module from the lower bracket if present, and rotating it slightly about its vertical axis to disengage it from the support column. Reversing the process can insert a new panel into the fencing run.

Figure 5:
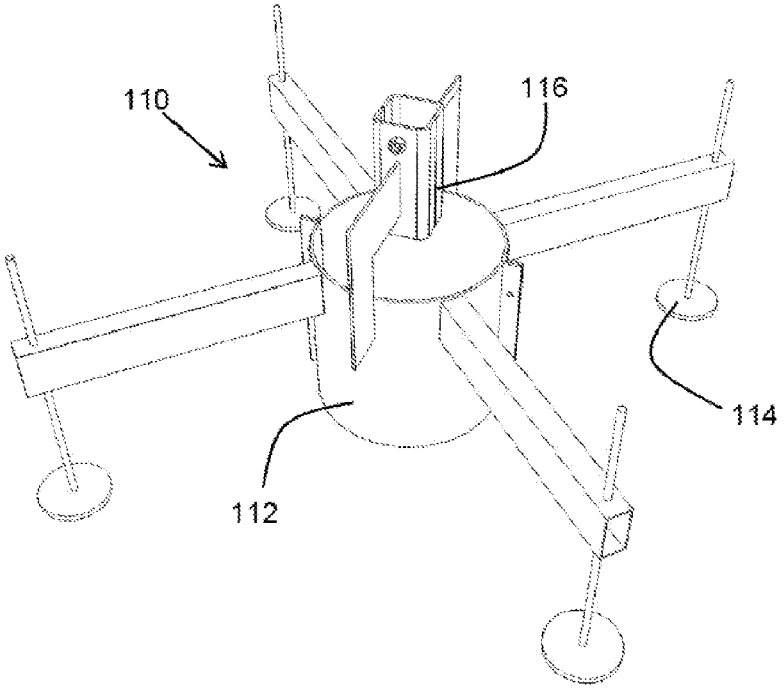
FIG. 5 is a top perspective view of a form for setting support posts into concrete footings to support the embodiment of FIG. 1.

To facilitate pouring a concrete footing 65 to support the present fencing system and embedding a support column 70 in the footing 65, an adjustable form 110 is provided. As seen in FIG. 5, form 110 includes a hollow form 112 into which concrete can be poured to form a footing or pile for support column 70 and the column element 40 which it supports. As will be understood in the art, the concrete for the footing or pile can be reinforced as required by use of reinforcing materials including but not limited to rebar. The form can be leveled when the ground is uneven by adjustment of levelling feet 114. A support column 70 can be inserted into the form 112 before or after the concrete is poured, and held in place by clamp 116 while the concrete sets, so as to provide a plumb and level footing or pile.

The embodiments described herein are intended to be illustrative of the present systems and methods and are not intended to limit the scope of the present invention. Various modifications and changes consistent with the description as a whole and which are readily apparent to the person of skill in the art are intended to be included. The appended claims should not be limited by the specific embodiments set forth in the examples, but should be given the broadest interpretation consistent with the description as a whole.

The invention claimed is:

1. A fencing system comprising:

a plurality of panel modules, each panel module having a first face, a second face, a top edge and a bottom edge, wherein each panel module comprises:

a central panel having a first side end and a second side end, the central panel defining a central plane;

a first semicolumnar projection extending from the first side end of the central panel parallel to the central plane and offset therefrom towards the first face, the first semicolumnar projection comprising a first slot extending between the top edge and the bottom edge, the first slot opening towards the second face and being in the form of a first elongated recess; and a second semicolumnar projection extending from the second side end of the central panel parallel to the central plane and offset therefrom towards the second face, the second semicolumnar projection comprising a second slot extending between the top edge and the bottom edge, the second slot opening towards the first face and being in the form of a second elongated recess, wherein overlapping coupling of the first semicolumnar projection of a first panel module with the second semicolumnar projection of an adjacent second panel module to align the first slot of the first panel module with the second slot of the second panel module provides an internal cavity, the first and second slots forming the internal cavity;

a substantially rigid and ground-engaging support column, wherein the support column is receivable in the internal cavity by transverse movement of the first semicolumnar projection of the first panel and the second semicolumnar projection of the adjacent second panel towards each other to enclose the support column, the first and second elongated recesses each being at least as wide as the support column to thereby receive the support column by said transverse movement, the support column comprising a first ground-engaging end and a second open end; and one or more connection brackets for fastening to the first and second panel modules so as to extend into the internal cavity and into the open end of the support column, the one or more connection brackets each comprising an engagement element configured to engage the support column at the open end.

2. The fencing system according to claim 1 wherein the panel module comprises at least one connection bracket receiving recess extending from at least one of the first side end and the second side end of the central panel along the top edge of the panel module and wherein the one or more connection brackets are fixedly receivable in the at least one connection bracket receiving recess so as to extend into the open end of the support column.

3. The fencing system according to claim 1 wherein the engagement element is laterally extendable from the connection bracket so as to engage one or more interior walls of the open end of the support column.

4. The fencing system according to claim 3 wherein the engagement element comprises one or more threaded elements laterally threadedly extendable from the connection bracket so as to engage the one or more interior walls of the open end of the support column, wherein lateral extension and retraction of the one or more threaded elements relative to the connection bracket is operable to adjust a vertical alignment of the panel module.

5. The fencing system according to claim 4, wherein the engagement element further comprises one or more jam nuts threadedly received on the one or more threaded elements and operable to restrict the lateral extension and retraction of the one or more threaded elements relative to the connection bracket.

6. The fencing system according to claim 1 further comprising a lower bracket, wherein the first semicolumnar projection and second semicolumnar projection each comprise a lower recess in the bottom edge thereof, and wherein the lower bracket comprises an aperture to receive the support column and one or more projections each receivable in the lower recess of the first semicolumnar projection or the second semicolumnar projection, thereby to retain and align either or both of the first semicolumnar projection and the second semicolumnar projection adjacent to the support column.

7. The fencing system according to claim 1, wherein the internal cavity has a substantially rectangular transverse profile.

8. The fencing system according to claim 7, wherein the support column has a substantially rectangular transverse profile.

* * * * *